United States Patent [19]

Stachurski et al.

[11] 4,421,626

[45] * Dec. 20, 1983

[54] BINDING LAYER FOR LOW OVERVOLTAGE HYDROGEN CATHODES

[75] Inventors: John Z. O. Stachurski, Amherst; Dirk Pouli, Williamsville; John A. Ripa, Lancaster; Gerald F. Pokrzyk, Lewiston, all of N.Y.

[73] Assignee: Occidental Chemical Corporation, Niagara Falls, N.Y.

[ * ] Notice: The portion of the term of this patent subsequent to Oct. 19, 1999 has been disclaimed.

[21] Appl. No.: 284,851

[22] Filed: Jul. 20, 1981

Related U.S. Application Data

[63] Continuation-in-part of Ser. No. 104,235, Dec. 17, 1979, Pat. No. 4,354,915.

[51] Int. Cl.[3] ..... C25B 11/06

[52] U.S. Cl. ..... 204/290 R; 204/293

[58] Field of Search ..... 204/293, 43 T, 290 R, 204/291

[56] References Cited

U.S. PATENT DOCUMENTS

| | | | |
|---|---|---|---|
| 2,216,605 | 10/1940 | Sklarew et al. | 204/DIG. 2 |
| 3,090,733 | 5/1963 | Brown | 204/40 X |
| 3,355,268 | 11/1967 | Du Rose et al. | 204/40 X |
| 4,152,240 | 5/1979 | Kuo | 204/290 R |
| 4,190,514 | 2/1980 | Matsuura et al. | 204/242 |
| 4,251,478 | 2/1981 | Welch et al. | 204/98 |
| 4,354,915 | 10/1982 | Stachurski et al. | 204/242 |

*Primary Examiner*—F. Edmundson

*Attorney, Agent, or Firm*—James F. Tao; William G. Gosz

[57] ABSTRACT

A cathode for use in electrolytic processes and a process for preparing such cathodes is described. The cathode comprises a cathodically active surface layer, an intermediate binding layer, and a substrate. The intermediate binding layer comprises a codeposit of a first metal selected from the group consisting of iron, cobalt, nickel, and mixtures thereof, and a second metal or metal oxide selected from the group consisting of molybdenum, manganese, titanium, tungsten, vanadium, indium, chromium, zinc, their oxides, and combinations thereof. The intermediate binding layer is applied to the substrate from an electroplating solution containing a soluble sulfur-containing compound, such as an alkali metal thiocyanate or thiourea. The surface layer is applied to the intermediate binding layer and comprises a codeposit of said first and second metals or metal oxides and a third metal selected from the group consisting of cadmium, mercury, lead, silver, thallium, bismuth, copper and mixtures thereof.

7 Claims, No Drawings

BINDING LAYER FOR LOW OVERVOLTAGE HYDROGEN CATHODES

CROSS-REFERENCE TO RELATED APPLICATION

This application is a continuation-in-part of copending application Ser. No. 104,235, filed Dec. 17, 1979 now U.S. Pat. No. 4,354,915.

BACKGROUND OF THE INVENTION

The present invention relates to improved cathodes for use in electrolytic cells. The cathodes of this invention have a novel intermediate binding layer between the substrate and surface layer for improved bonding of the surface layer to the substrate under normal cell operating conditions. The cathodes of the present invention are particularly useful in the electrolysis of aqueous solutions of alkali metal halides to produce alkali metal hydroxides and halogens, or in the electrolysis of aqueous solutions of alkali metal halides to produce alkali metal halates, or in water electrolysis to produce hydrogen.

In an electrochemical cell, large quantities of electricity are consumed to produce alkali metal hydroxides, halogens, hydrogen, and alkali metal halates in electrochemical processes familiar to those skilled in the art. With increased cost of energy and fuel, the savings of electricity, even in relatively minor amounts, is of great economic advantage to the commercial operator of the cell. Therefore, the ability to affect savings in electricity through cell operation, cell design, or improvement in components, such as anodes and cathodes, is of increasing significance.

In such electrolytic processes, hydrogen is evolved at the cathode, and the overall reaction may be theoretically represented as:

$$2H_2O+2e^-\rightarrow H_2+2OH^- \quad (1)$$

However, the cathode reaction actually produces monoatomic hydrogen on the cathode surface, and consecutive stages of reaction (1) can be represented as follows:

$$H_2O+e^-\rightarrow H+OH^-$$

$$2H\rightarrow H_2 \quad (2)$$

or as:

$$H_2O+e^-\rightarrow H+OH^-$$

$$H+H_2O+e^-\rightarrow H_2+OH^- \quad (3)$$

The monoatomic hydrogen generated as shown in reactions (2) or (3) is adsorbed on the surface of the cathode and desorbed as hydrogen gas.

The voltage or potential that is required in the operation of an electrolytic cell includes the total of the decomposition voltage of the compound being electrolyzed, the voltage required to overcome the resistance of the electrolyte, and the voltage required to overcome the resistance of the electrical connections within the cell. In addition, a potential, known as "overvoltage" is also required. The cathode overvoltage is the difference between the thermodynamic potential of the hydrogen electrode (at equilibrium) and the potential of an electrode on which hydrogen is evolved due to an impressed electric current. The cathode overvoltage is related to such factors as the mechanism of hydrogen evolution and desorption, the current density, the temperature and composition of the electrolyte, the cathode material and the surface area of the cathode.

In recent years, increasing attention has been directed toward improving the hydrogen overvoltage characteristics of electrolytic cell cathodes. In addition to having a reduced hydrogen overvoltage, a cathode should also be constructed from materials that are inexpensive, easy to fabricate, mechanically strong, and capable of withstanding the environmental conditions of the electrolytic cell. Iron or steel fulfills many of these requirements, and has been the traditional material used commercially for cathode fabrication in the chlor-alkali industry. When a chlor-alkali cell is by-passed, or in an open circuit condition, the iron or steel cathodes becomes prone to electrolyte attack and their useful life is thereby significantly decreased.

Steel cathodes generally exhibit a cathode overvoltage in the range of from about 300 to about 500 millivolts under typical cell operating conditions, for example, at a temperature of about 100° C. and a current density of between about 100 and about 200 milliamperes per square centimeter. Efforts to decrease the hydrogen overvoltage of such cathodes have generally focused on improving the catalytic effect of the surface material or providing a larger effective surface area. In practice, these efforts have frequently been frustrated by cathodes or cathode coatings which have been found to be either too expensive or which have only a limited useful life in commercial operation.

Various coatings have been suggested to improve the hydrogen overvoltage characteristics of electrolytic cell cathodes in an economically viable manner. A significant number of the prior art coatings have included nickel, or mixtures, alloys or intermetallic compounds of nickel with various other metals. Frequently, when nickel is employed in admixture with another metal or compound, the second metal or compound can be leached or extracted in a solution of, for example, sodium hydroxide, to provide a high surface area coatings, such as Raney nickel coatings.

Representative coatings of the prior art are disclosed in U.S. Pat. No. 3,291,714, issued Dec. 13, 1966, and U.S. Pat. No. 3,350,294, issued Oct. 31, 1967. These patents disclose inter alia cathode coatings comprisng alloys of nickel-molybdenum or nickel-molybdenum-tungsten electroplated on iron or steel substrates. The electro-deposition of nickel-molybdenum alloys utilizing a pyrophosphate bath is also discussed by Havey, Krohn, and Hanneken in "The Electrodeposition of Nickel-Molybdenum Alloys", *Journal of the Electrochemical Society,* Vol. 110, page 362, (1963).

Other attempts have been made in the prior art to produce coatings of this general variety which offer an acceptable compromise between coating life and low overvoltage characteristics. U.S. Pat. No. 4,105,532, issued Aug. 8, 1978, and U.S. Pat. No. 4,152,240, issued May 1, 1979, are representative of these attempts disclosing, respectively, alloys of nickel-molybdenum-vanadium and nickel-molybdenum using specially selected substrate and intermediate coatings of copper and/or dendritic copper. Similar coatings are also disclosed in U.S. Pat. Nos. 4,033,837 and 3,291,714.

The surface treatment of a Raney nickel electrode with a cadmium nitrate solution for the purpose of reducing hydrogen overvoltage has been investigated by Korovin, Kozlowa and Savel'eva in "Effect of the Treatment of Surface Raney Nickel with Cadmium Nitrate on the Cathodic Evolution of Hydrogen", *Soviet Electrochemistry,* Vol. 14, page 1266 (1978). Although the initial results of such a coating exhibit a good reduction in hydrogen overvoltage, it has been found that the overvoltage increases rapidly to the original level after a short period of operation, i.e. about 2 hours.

Copending application Ser. No. 104,235, filed Dec. 17, 1979, addresses the problem of low hydrogen overvoltage by disclosing a novel cathode having an active surface layer comprising, as a preferred embodiment thereof, a codeposit of nickel, molybdenum or an oxide thereof, and cadmium. This application also describes various intermediate protective layers which can be suitably interposed between the substrate and active surface layer to protect the substrate from the corrosive effects of the electrolytic cell environment. Such layers include nickel and various alloys or mixtures of nickel with other metals.

Although the cathodes disclosed in the copending application exhibit good adherence of the coating to the substrate under normal conditions, there exists a continuing need to maximize the life of the cathode under the conditions actually prevailing during the commercial operation of an electrolytic cell. Many of the prior art attempts at reducing the hydrogen overvoltage of the cathode, while initially successful have ultimately failed due to rapid deterioration of the coating in the caustic environment, ultimately causing the coating to separate from the substrate material.

BRIEF DESCRIPTION OF THE INVENTION

In accordance with the present invention, there is provided a cathode for use in electrolytic processes, and a method for producing such cathodes. The cathodes of this invention are fabricated by first applying an intermediate binding layer to a suitable substrate material, and subsequently applying the active surface coating to at least a portion of the binding layer. In general, the substrate materials are known in the art and comprise, for example, nickel, titanium, or a ferrous metal, such as iron or steel. The intermediate binding layer is formed by codepositing onto the substrate a mixture of a first metal selected from the group consisting of iron, cobalt, nickel, and mixtures thereof, and a second metal or metal oxide selected from the group consisting of molybdenum, manganese, titanium, tungsten, vanadium, indium, chromium, zinc, their oxides, and combinations thereof. The intermediate binding layer is applied from an electroplating bath or solution containing a soluble sulfur-containing compound, such as an alkali metal thiocyanate or thiourea.

The surface portion is formed from a codeposit of said first metal and second metals or metal oxides, and a third metal selected from the group consisting of cadmium, mercury, lead, silver, thallium, bismuth, copper, and mixtures thereof. At least a portion of the second metal or metal oxide is subsequently removed, suitably by leaching using an alkaline solution, such as an aqueous solution of an alkali metal hydroxide. The leaching operation can be performed prior to placing the cathode in operation in an electrolytic cell, or during actual operation in the cell by virtue of the presence of an alkali metal hydroxide in the electrolyte. Optionally, the cathodes of the present invention can be heat treated either before or after at least partial leaching to improve the performance even further. The preferred surface coating of the present invention comprises a codeposit of nickel, molybdenum, and cadmium.

DETAILED DESCRIPTION OF THE INVENTION

The present cathode comprises a substrate material, an intermediate binding layer, and an active surface layer. The substrate may be selected from any suitable material having the required electrical and mechanical properties, and the chemical resistance to the particular electrolytic solution in which it is to be used. Generally, conductive metals or alloys are useful, such as ferrous metals (iron or steel), nickel, copper, or valve metals such as tungsten, titanium, tantalum, niobium, vanadium, or alloys of these metals, such as a titanium/palladium alloy containing 0.2% palladium. Because of their mechanical properties, ease of fabrication, and cost, ferrous metals, such as iron or steel, are commonly used in chlor-alkali cells. However, in chlorate cells where corrosion of the substrate material is a significant problem, titanium or titanium alloys are preferred.

The intermediate binding layer can then be applied directly to the substrate material. Alternately, if a substrate material other than nickel is utilized, a Watts nickel layer can be applied to the substrate as an undercoating, and the intermediate binding layer can then be applied directly to the Watts nickel layer. The intermediate binding layer comprises a codeposit of a first metal selected from the group consisting of iron, cobalt, nickel, and mixtures thereof, and a second metal or metal oxide selected from the group consisting of molybdenum, manganese, titanium, tungsten, vanadium, indium, chromium, zinc, their oxides, and combinations thereof, said codeposit being applied to the substrate from a plating solution. The plating solution contains a soluble sulfur-containing compound which serves to improve the deposition of the binding layer and also serves to improve the adhesion of the surface coating to the substrate. Suitable sulfur-containing compounds include alkali metal thiocyanates, such as potassium thiocyanate, and thiourea.

Prior to coating the substrate in the plating bath, the substrate is preferably cleaned to insure good adhesion of the binding layer. Techniques for such preparatory cleaning are conventional and well known in the art. For example, vapor degreasing or sand or grit blasting may be utilized, or the substrate may be etched in an acidic solution or cathodically cleaned in a caustic solution.

After cleaning, the substrate can then be immersed in a plating bath to simultaneously codeposit said first metal and second metal or metal oxide. The basic electroplating technique which can be utilized in this invention is known in the prior art. For example, U.S. Pat. No. 4,105,532, issued Aug. 8, 1978, and Havey, Krohn, and Hannekin in "The Electrodeposition of Nickel-Molybdenum Alloys", *Journal of the Electrochemical Society,* Vol. 110, pages 362 (1963) describe, respectively, typical sulfate and pyrophosphate plating solutions. By way of illustration, a suitable plating bath composition for codepositing a binding layer of nickel and molybdenum or molybdenum oxide according to the present invention is as follows:

| | |
|---|---|
| $Na_2Mo_4.2H_2O$ | 0.012M |
| $NiCl_2.6H_2O$ | 0.040M |
| $Na_2P_2O_7.10H\ 2O$ | 0.130M |

-continued

| | |
|---|---|
| $NaHCO_3$ | 0.893M |
| NaCl | 1.07M |
| $Na_3C_6H_5O_7.2H_2O$ | 0.10M |
| Hydrazine Sulfate | 0.0254M |
| $CdCl_2.2\frac{1}{2}H_2O$ | $3.0 \times 10^{-4}$M |
| KSCN | $2.4 \times 10^{-3}$M' |
| *TRITON X - 100 | 0.020g./l. |

*Trademark of the Rohm & Haas Chemical Company

The concentration of the potassium thiocyanate in the electroplating solution can vary within wide limits, although a concentration in the range of from about 0.1 g./l. to about 1.0 g./l. is generally preferred. Other sources of nickel and molybdenum, such as other soluble salts of these metals, as well as other sulfur-containing compounds, e.g. thiourea, can be utilized in place of the specific compounds listed above. Preferably, the molybdenum component of the binding layer is present in an amount of from about 0.5 to about 40 atomic percent.

The active surface portion of the cathode is formed by codepositing onto the intermediate binding layer a mixture of the first metal and second metal or metal oxide, and a third metal selected from the group consisting of cadmium, mercury, lead, silver, thallium, bismuth, copper, and mixtures thereof. The first and third metals can be characterized as being substantially non-leachable, i.e. they are removed very slowly, if at all, by leaching or extraction in an alkaline solution. The second metal or metal oxide forming the codeposit is a leachable component, i.e. a substantial portion of this component is removable by leaching in an alkaline solution. Hence, the proportions of the metals in the surface composition can be initially expected to change during operation in the cell, primarily due to the extraction or leaching of the second metal or metal oxide component. The leaching action may be so extensive that virtually all of the second metal or metal oxide is removed from the codeposit. Under such circumstances, the absence of measurable amounts of the second metal does not have an adverse effect on the performance of the cathode. In fact, leaching actually improves the performance of the cathode by increasing the roughness and surface area of the cathode surface. Accordingly, cathodes having measurable quantities of only the first and third metal components in the codeposit after leaching are included within the scope of this invention.

In one embodiment, suitable active cathode surfaces can be formed from a codeposit initially containing only the first and third metal components, provided that the surface of the cathode has a roughness factor (defined as the ratio of the measurable surface area of the geometrical surface area) sufficiently high enough to provide the desired decrease in hydrogen overvoltage. An acceptable surface roughness factor in the context of this invention would be at least about 100, and preferably at least about 1,000. Such cathodes can be prepared, for example, using chemical vapor deposition techniques, or by more conventional techniques, such as thermal fusion of the metals and subsequently etching the surface with a strong mineral acid. In this particular embodiment, the composition of the active surface preferably contains from about 0.5 to about 20 atomic percent, and most preferably from about 1 to about 10 atomic percent, of the third metal component.

In another embodiment, when all three metals or metal oxides are present, the composition of the surface layer contains less than about 40 atomic percent, and preferably more than about 0.5 atomic percent, of the second metal, and from about 0.5 to about 25 atomic percent, preferably about 1 to about 10 atomic percent, of the third metal, the balance of the surface layer comprising the first metal component. Surprisingly, it has been found that if the quantity of the second metal present in the surface layer does not exceed about 40 atomic percent, the cathode is remarkably stable and exhibits minimal deterioration during sustained operation in electrolytic environments.

The preferred metals of the surface layer are nickel, molybdenum, and cadmium present in the range of from about 0.5 to about 40 atomic percent of molybdenum, and from about 0.5 to about 20 atomic percent, and preferably from about 1 to about 10 atomic percent, of cadmium, based on the combined weight of nickel, molybdenum and cadmium, the nickel comprising the balance of the mixture. Such a cathode has been found to produce surprisingly good results when utilized to electrolyze sodium chloride.

Techniques for depositing the surface layer, as well as additional details concerning the thickness of the coating, conditions for leaching and heat treatment are more full described in copending application Ser. No. 104,235, filed Dec. 17, 1979, the disclosure of which is incorporated herein by reference.

The term "codeposit" as used in the present specification and claims, embraces any of the various alloys, compounds and intermetallic phases of the particular metals or metal oxides, and does not imply any particular method or process of formulation.

The cathodes of the present invention have applications in many types of electrolytic cells and can function effectively in various electrolytes. Cathodes having an assortment of configurations and designs can be easily coated using the electroplating technique of this invention, as will be understood by those skilled in the art.

The following examples further illustrate and describe the various aspects of the invention, but are not intended to limit it. Various modifications can be made in the invention without departing from the spirit and scope thereof, as will be readily appreciated by those skilled in the art. Such modifications and variations are considered to be within the purview and scope of the appended claims.

EXAMPLE

Two steel cathodes are pickled in 1:1 HCl and plated with an undercoating layer of Watts nickel. The Watts nickel coating is rinsed in a $NH_4OH/NH_4Cl$ solution and an intermediate binding layer is electroplated over the Watts nickel layer from an electroplating solution comprising 0.016 M of $Na_2MoO_4.2H_2O$, 0.04 M of $NiCl_2.6H_2O$, 0.13 M of $Na_4P_2O_7.10H_2O$, 2.50 M of $KHCO_3$, 0.0254 M of Hydrazine sulfate, $1.5\times10^{-4}$ M of $Cd(No_3)_2.4H_2O$, $1.5\times10^{-4}$ M of $ZnCl_2$ and $2.9\times10^{-4}$ M of KSCN. During the plating of the intermediate binding layer, each cathode is spaced $\frac{5}{8}$" apart from the corresponding anode. A NAFION membrane is positioned between the anode and cathode, and a 3 molar NaOH solution is used as the anolyte solution. Plating is continued for 15 minutes at a current density of 0.75 A/in$^2$ and a temperature of between 21° C. and 24° C. The initial solution pH of 8.4 is increased to 8.6 during plating and a solution volume of 80 ml/in$^2$ of cathode area is used for plating. The intermediate binding layer is first rinsed with water and then rinsed with a solution of $NH_4OH/NH_4Cl$, and an active surface layer is electroplated over the intermediate binding layer from an electroplating solution containing 0.02 M $Na_2MoO_4$, 0.04 M $NiCl_2$, 0.13 M $Na_4P_2O_7$, 0.89 M $NaHCO_3$, 0.025 M $N_2H_4.H_2SO_4$, and $3.0\times10^{-4}$ M $Cd(NO_3)_2$. The plating is carried out at 20° C. at a current density of 0.75 A/in$^2$ for 30 minutes. The cathodes are leached in 20% NaOH for 15 hours at 70° C. and subsequently heat treated at 275° C. for 1 hour.

SEM photos are taken of a cathode prepared according to the procedure set forth in the Example and compared to SEM photos of a cathode prepared following the same procedure except that an intermediate binding layer is omitted. The photos show considerable separation of the coating layer for the cathode that does not have a binding layer, while the cathode of this invention exhibits only cracks perpendicular to the substrate with little adverse effect on coating adherence or durability.

What is claimed is:

1. A cathode for use in electrolytic processes comprising a substrate material, an intermediate binding layer applied to the substrate, and a surface layer applied to the binding layer, said surface layer comprising a codeposit of a first metal selected from the group consisting of iron, cobalt, nickel, and mixtures thereof, a second metal or metal oxide selected from the group consisting of molybdenum, manganese, titanium, tungsten, vanadium, indium, chromium, their oxides and combinations thereof, and from about 0.5 to about 25 atomic percent of a substantially nonleachable third metal selected from the group consisting of cadmium, mercury, lead, thallium, bismuth, and mixtures thereof, said intermediate binding layer comprising a codeposit of said first metal and said second metal or metal oxide applied to the substrate from an electroplating solution containing an alkali metal thiocyanate or thiourea.

2. The cathode of claim 1 wherein the substrate material is nickel.

3. The cathode of claim 1 wherein the substrate material is a ferrous metal.

4. The cathode of claim 3 wherein a nickel undercoating is applied between the binding layer and the substrate.

5. The cathode of claim 1 wherein the first metal in the surface layer is nickel, the second metal is molybdenum, and the third metal is cadmium.

6. The cathode of claim 5 wherein the molybdenum in the surface layer is present in the range of from about 0.5 to about 40 atomic percent, and the cadmium is present in the range of from about 1 to about 10 atomic percent, based on the three metals in the surface layer.

7. The cathod of claim 1 wherein the electroplating solution contains from about 0.1 g./l. to about 1.0 g./l. of alkali metal thiocyanate.

* * * * *